United States Patent [19]

Chiou

[11] Patent Number: 4,979,525

[45] Date of Patent: Dec. 25, 1990

[54] CASSETTE SANITARY KIT

[76] Inventor: Jeng-Jong Chiou, 3F-1, No. 337, Sec. 4, Hsin Yi Rd., Taipei, Taiwan

[21] Appl. No.: 169,065

[22] Filed: Mar. 17, 1988

[51] Int. Cl.[5] ..... A45D 40/00

[52] U.S. Cl. ..... 132/286; 132/289; 206/581

[58] Field of Search ..... 206/581, 228, 234, 235, 206/38, 373; 132/286, 289, 308, 313, 314, 315

[56] References Cited

U.S. PATENT DOCUMENTS

| | | | |
|---|---|---|---|
| 1,652,771 | 12/1927 | Deubel | 206/581 |
| 1,722,507 | 7/1929 | Stanley | 206/581 |
| 1,758,338 | 5/1930 | Simos | 206/228 |
| 1,947,604 | 2/1934 | Lewis | 132/315 |
| 2,097,938 | 11/1937 | Sundin | 132/313 |
| 2,382,061 | 8/1945 | Janchick | 206/228 |
| 2,411,196 | 11/1946 | Dolan | 132/315 |
| 2,593,896 | 4/1952 | Kollontay | 132/314 |
| 2,669,017 | 2/1954 | Seko | 206/581 |

FOREIGN PATENT DOCUMENTS

| | | | |
|---|---|---|---|
| 0259257 | 6/1949 | France | 132/315 |

*Primary Examiner*—Gene Mancene
*Assistant Examiner*—Adriene B. Lepiane
*Attorney, Agent, or Firm*—Lowe, Price, LeBlanc, Becker & Shur

[57] ABSTRACT

A cassette sanitary kit is described. The kit includes a cassette comprising a base with locations for the placement of a toothbrush and a handle between stop plates on the base, and locations for a soapsuds container and a shaving cream container between a stop and a division plate on the base, for attachment of a razor holder to a protruding block on the base, for the placement of nail clippers in a trough, for the arrangement of a cologne water container in a round hole on the base, for receiving a set of razor connecting elements in a track, and for the insertion of a comb in a cavity on the underside of the base.

1 Claim, 5 Drawing Sheets

CASSETTE SANITARY KIT

BACKGROUND OF THE INVENTOIN

The present invention relates to a cassette sanitary kit, more particularly a cassette having a base thereinside for the placement of a tooth brush and a handle bar between stop plates on the base, locations for a soap-suds container and a cologne water container between a stop rod and a plate on the base, locations for a razor holder, for nail clippers in a channel, for a cologne water container in a round hole in the base, for a set of razor connecting elements in a track, and for the insertion of a comb into a cavity in the underside of the base. The arrangement and assembly above-described forms a compact cassette sanitary kit with a complete series of accessories firmly allocated thereinside.

SUMMARY OF THE INVENTION

The present invention is a cassette sanitary kit for washing oneself, which comprises a plurality of locations for respective arrangement of hair and tooth brushes and a handle to firmly retain these articles therein, a division plate and stop are also provided for retaining soap suds and shaving cream containers. A location for a razor holder is also provided, as well as locations for nail clippers and a cologne water container, two razor connecting elements are located at both sides of an internal track, and a concave plane for the placement of a comb is provided with two depending posts which are received in notches of the comb to form an assembly of the present cassette sanitary kit.

DESCRIPTION OF THE THE PREFERRED EMBODIMENTS

Figure 1:
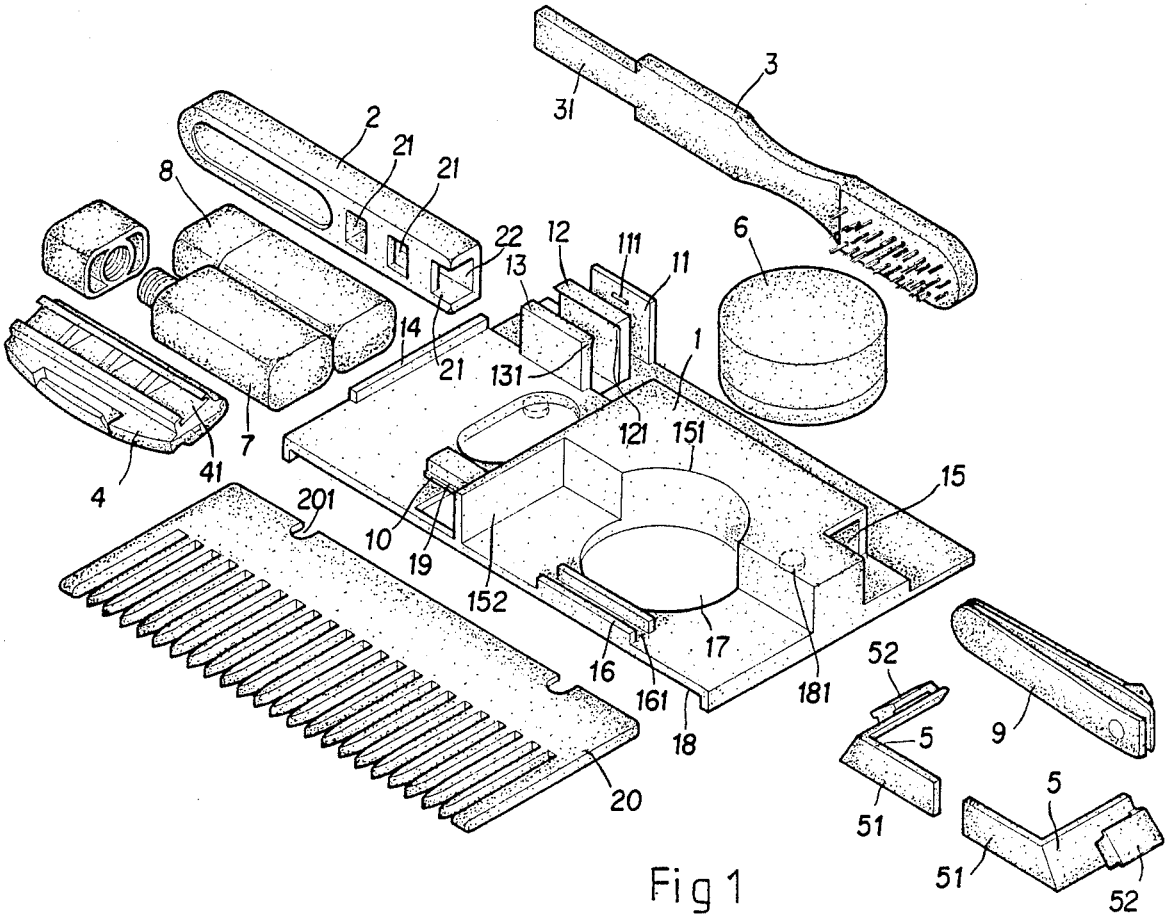
FIG. 1 is a fragmentary perspective view of a cassette sanitary kit embodying the present invention.
Figure 2:
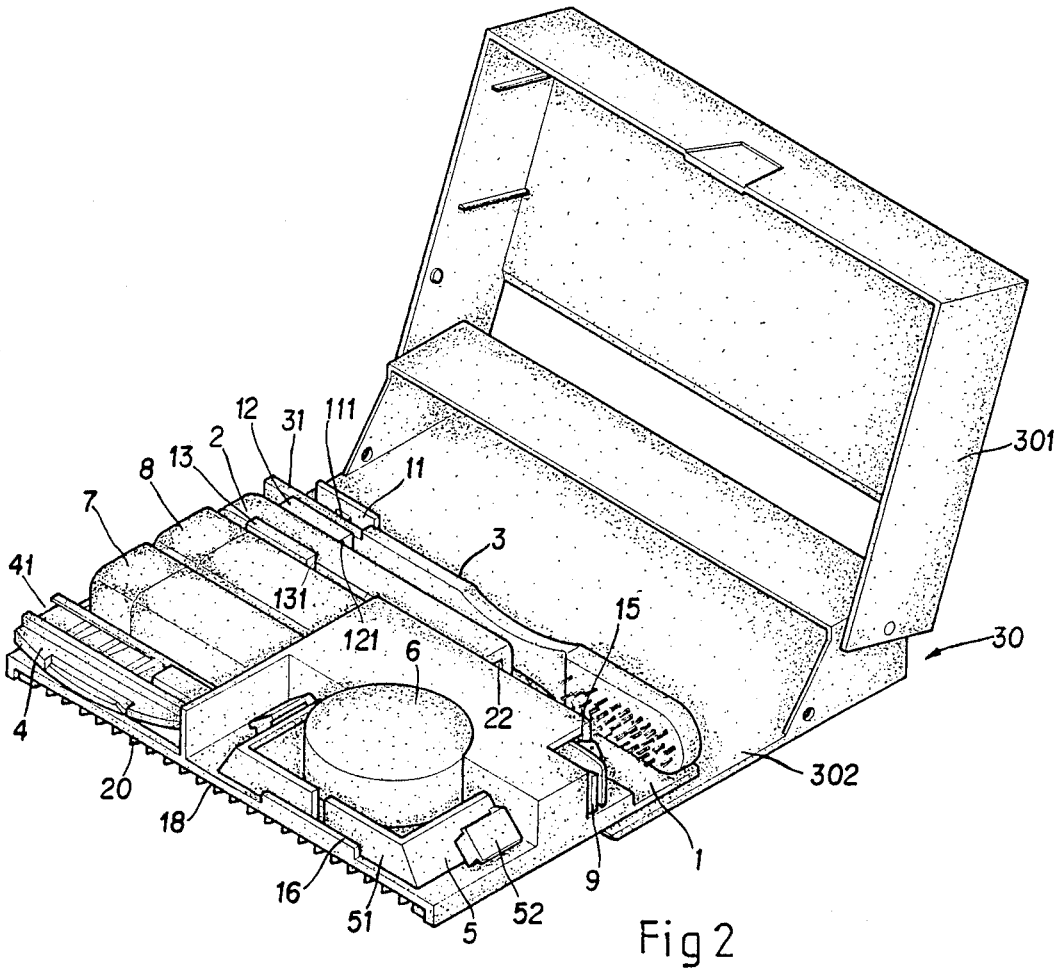
FIG. 2 is a perspective assembly view of the preferred embodiment.

As shown in FIG. 1 and FIG. 2, the present invention is composed of a base 1 mounting a handle bar 2, a tooth brush 3, a razor holder 4, two razor connecting elements 5, a cologne water container 6, soap-suds container 7, a shaving cream container 8, nail clippers 9, a comb 20 in a cassette 30. Said base 1 comprises a plurality of stop plates 11, 12, 13. Said stop plate 11 has a nose 111 and stop plates 12 and 13 each have a curved face 121 and 131, respectively, on the inner side thereof. Stop plates 11 and 12 receive tooth brush 3, and stop plates 12 and 13 receive handle bar 2. Said base 1 further comprises a receiving trough 15 for receiving nail clippers 9. Said receiving trough 15 has a curved face 151 at one side from which a round hole 17 extends and receives said cologne water container 6. Division plate 152 also extends from said receiving trough 15. Said base 1 has a stop 14 for soap-suds container 7 and shaving cream container 8 which are placed between the stop 14 and plate 152 and between stop block 13 and the razor 4. Said base 1 has two protruding plates 16 to form a locating track 161 for the razor connection elements 5 by means of the vertical ends 51 fit in locating track 161. Said base 1 has a cavity 18 at the bottom for mounting comb 18 by means of depending axles 181 matching with the notches 201 of the comb 20.

Figure 3:
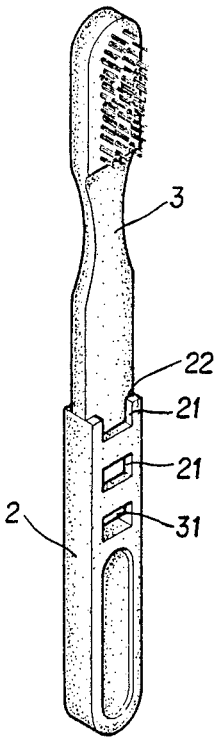
FIG. 3 illustrates the assembly of a handle bar and a tooth brush according to the present invention.
Figure 4:
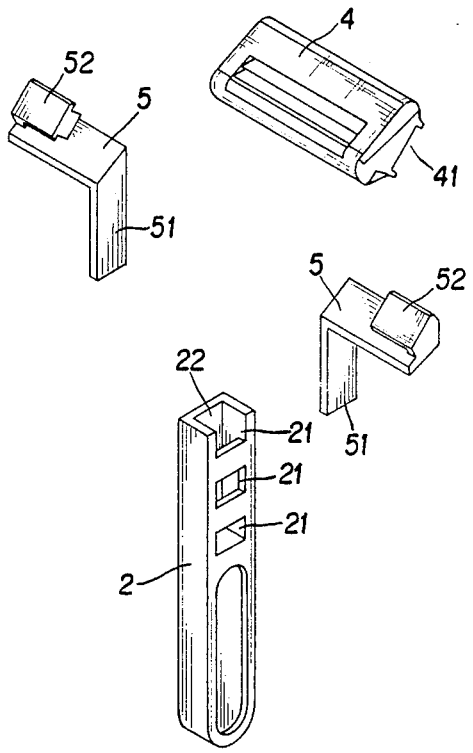
FIG. 4 is a fragmentary perspective view of a handle bar, a razor holder and a connecting element while in separation.
Figure 5:
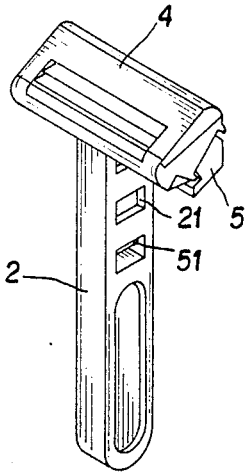
FIG. 5 is a perspentive view of the assembly of handle bar, razor holder and connecting element.

Said handle bar 2 has a plurality of notches 21 at one side to reduce the contact face and an indentation 22 to receive the tooth brush 3 or razor connecting elements 5. Indentation 22 in the handle bar 2 is for connection with the connecting plate 31 of the tooth brush 3 or the vertical ends 51 of the two razor connecting elements 5. The mounting of tooth brush 3 by plate 31 in indentation 22 of the handle bar 2, is shown in FIG. 3. The razor holder 4 has tracks 41 for receiving tabs 52 of the connecting elements 5. Said two razor connecting elements 5 are symmetrically identical and can be respectively connected with razor holder 4 and handle bar 2, tabs 52 mounting the razor holder 4 and the vertical ends 51 of each connecting elements 5 received in indentation 22 of the handle bar 2 as shown in FIG. 4.

The cologne water container 6, soap-suds container 7 and shaving cream container 8 can be refilled whenever required, and can be interchangeable. Said nail clippers 9 are directly placed in the receiving trough 15 and can be picked up for ready use when required. Said comb 20 is placed at the bottom of the base 1, and can be easily picked up by simply pulling the notches 201 away from the protruding axles 181. Said cassette case 30 is composed of an upper cover 301 and a lower cover 302 connected by a hinge and receives said base 1 and all the accessories contained in the base 1 to complete an assembly of the present cassette sanitary kit.

The tooth brush 3 when located between stop plates 11, 12 is firmly retained therebetween by means of a nose 111 to keep it from breaking away. The handle bar 2 when placed between the stop plates 12, 13 is firmly retained by means of the respective curved face 121, 131 therebetween. Division plate 152 has a protruding block 10 with a trough 19 for the attachment of the razor holder 4 by means of its track 41 as shown in FIG. 2.

As the assembly is completed and all the accessories are well allocated, they are orderly arranged and firmly secured to provide a compact and complete cassette sanitary kit.

I claim:

1. A cassette sanitary kit comprising:

a cassette, a base mounted in said cassette having an upper and a lower surface, said upper surface mounting three upstanding, mutually spaced stop plates, retaining means mounted on each of said plates for retaining in the two spaces therebetween, respectively, a tooth brush head and an elongated handle; a tooth brush head releasably mounted between two of said plates in one of the spaces; a handle releasably mounted between two of said plates in the other of the spaces, mounting means disposed at an end of said handle for releasably mounting said toothbrush head;

said base further defining a circular depression adapted to receive the base of a cylindrical cosmetic container; an upstanding division plate mutually spaced away from an edge of said base perpendicular to said stop plates; a stop member extending along said base edge; and a stop block spaced away from said stop plates, said stop member, stop block and division plate defining with a side of one of said stop plates, a rectangular retention area for receiving containers of cosmetics;

said base further defining an upstanding trough and a sleeve;

a razor head holder means releasably mounted in said trough, means carried by said holder means for releasably mounting a razor head thereon and for releasably mounting said holder means on said handle; a razor slidably received on said stop block;

nail clippers slidably received in the sleeve; and the lower surface of said base defining a cavity adapted to receive a comb and a comb releasably mounted in the cavity and comb retaining means in the cavity for releasably retaining said comb therein.

* * * * *